US008584803B2

(12) United States Patent
Sani

(10) Patent No.: US 8,584,803 B2
(45) Date of Patent: Nov. 19, 2013

(54) MULTI-POINT SUSPENDED SCAFFOLD

(76) Inventor: Roberto Ubaldo Arduino Sani, Dartmouth (CA)

( * ) Notice: Subject to any disclaimer, the term of this patent is extended or adjusted under 35 U.S.C. 154(b) by 553 days.

(21) Appl. No.: 12/508,797

(22) Filed: Jul. 24, 2009

(65) Prior Publication Data

US 2010/0018802 A1 Jan. 28, 2010

Related U.S. Application Data

(60) Provisional application No. 61/129,860, filed on Jul. 24, 2008.

(51) Int. Cl.
*E04G 3/32* (2006.01)

(52) U.S. Cl.
USPC ..... 182/142; 185/150; 185/112

(58) Field of Classification Search
USPC ..... 182/142, 145, 150, 112, 113, 143, 144
See application file for complete search history.

(56) References Cited

U.S. PATENT DOCUMENTS

| | | | | | |
|---|---|---|---|---|---|
| 854,959 | A | | 5/1907 | Murray | |
| 959,008 | A | | 5/1910 | Henderson | |
| 1,085,607 | A | | 2/1914 | Haynes | |
| 1,127,445 | A | | 2/1915 | Johnston | |
| 1,127,446 | A | | 2/1915 | Johnston | |
| 1,187,060 | A | | 6/1916 | Golden | |
| 1,244,670 | A | * | 10/1917 | Whitney | 182/113 |
| 1,550,364 | A | | 8/1925 | Johnston | |
| 1,655,562 | A | | 1/1928 | Powers | |
| 1,725,183 | A | | 8/1929 | Fischer | |
| 2,057,092 | A | | 10/1936 | Geib | |
| 2,600,199 | A | * | 6/1952 | Brewster | 182/113 |
| 2,833,596 | A | * | 5/1958 | Borgman et al. | 182/132 |
| 2,928,642 | A | * | 3/1960 | Anderson et al. | 248/245 |
| 3,752,262 | A | * | 8/1973 | Helms | 182/113 |
| 4,401,186 | A | * | 8/1983 | Dobersch | 182/113 |
| 4,787,475 | A | * | 11/1988 | Arteau et al. | 182/82 |
| 4,997,062 | A | * | 3/1991 | Pizzo | 182/132 |
| 5,145,032 | A | * | 9/1992 | Puccinelli et al. | 182/142 |
| 5,394,956 | A | | 3/1995 | Hulse | |
| 5,617,931 | A | | 4/1997 | Zygmun | |
| 6,264,001 | B1 | | 7/2001 | Herschbach | |

FOREIGN PATENT DOCUMENTS

| | | | |
|---|---|---|---|
| AU | 2006100471 | * | 7/2006 |
| GB | 2379241 | * | 8/2001 |

* cited by examiner

*Primary Examiner* — Alvin Chin Shue
*Assistant Examiner* — Daniel Cahn
(74) *Attorney, Agent, or Firm* — Mattingly & Malur, PC

(57) ABSTRACT

A multi-point suspended scaffold utilizes a pair of spaced scaffold frames, each of which is provided with suspension cables which support the scaffold from outrigger beams of a building. The two scaffold frames are connected to each other by wire mesh trusses. These wire mesh trusses incorporate guard rails, toeboards, and an object retaining mesh. Upper and lower cross braces are also secured between adjacent ones of the scaffold frames. The cooperation of the wire mesh trusses, the cross bracing and the use of secured footboards provides a suspended scaffold that is structurally rigid while being easily assembled and disassembled.

17 Claims, 6 Drawing Sheets

MULTI-POINT SUSPENDED SCAFFOLD

CROSS-REFERENCE TO RELATED APPLICATIONS

This application claims priority to U.S. provisional patent application No. 61/129,860, filed Jul. 24, 2008. The disclosure of that U.S. provisional patent application is expressly incorporated herein by reference.

FIELD OF THE INVENTION

The present invention is directed generally to a multi-point suspended scaffold. More specifically, the present invention is directed to a suspended scaffold having wire mesh trusses. Most particularly, the present invention is directed to a suspended scaffold including vertical frame members, wire mesh trusses and horizontal cross bracing. The multi-point suspended scaffold includes pairs of spaced suspension pick-up points. The scaffold is intended for use primarily on high-rise buildings. The frames, wire mesh trusses and horizontal cross braces provide a scaffold with sufficient structural integrity and redundancy necessary for safety in the event of a failure of one or more of the suspending cables. The wire mesh trusses can be provided with integrated guard rails and toeboards that are required by statute. The scaffold provides two decks at a main level and one deck at a lower working level.

BACKGROUND OF THE INVENTION

The construction and maintenance of multi-story buildings, such as high-rise office and residential buildings is accomplished, in part, through the use of multi-point suspended scaffolds. Such buildings are provided, typically along their upper roof edge, with a plurality of spaced cantilever or outrigger beams. These beams are pivotable, about a suitable pivot axis at the building edge, or are slidable into a cantilever position in which the beams extend out from the walls of the building. These beams are typically spaced apart at a uniform distance and are usable to support the suspended scaffolds which are used by masons, glaziers, window washers and similar building repair and maintenance personnel.

Scaffolds are suspended by cables from the cantilever outrigger beams and are movable vertically with respect to the walls of the building or other structures by winches. These winches are attached to the frame of the scaffolds and may be manually operated or may be powered by electricity or the like. In use, the winches are operated to raise or lower the scaffold to the appropriate work level.

One or more workmen will use the scaffold assembly as a work platform from which to perform the masonry work required in the construction of the building, the installation of window walls that may be utilized in the building construction, the application of metal fascia pieces, the installation of caulking and similar tasks. It is imperative that the scaffolds be provided with sufficient structural rigidity and strength to insure that the scaffold will not collapse under load and will not fall apart in the event of, for example, one of the cables failing or slipping on its associated winch. Various government codes and regulations have dictated that a scaffold be able to meet certain safety standards with respect to strength, durability and failure resistance.

In prior scaffolds, the structures have been complex and cumbersome. A large number of components have had to be assembled to form the resulting scaffold. Since the typical scaffold is assembled at a point of use, used over a finite period of time, and is then disassembled and taken to a new point of use, the assembly and disassembly times that are required are of importance. In prior scaffolds, the use of a large number of individual components has required a substantial amount of time to accomplish the assembly and disassembly of the scaffolds. The expenditure of such a large amount of time is costly.

Since each scaffold is typically suspended at a distance above the ground and must support the weight of one or more workmen and their equipment and supplies, the scaffold must have sufficient structural strength and rigidity to accomplish this task. In prior systems, this has tended to result in the use of large, strong components which also have a great deal of weight. This weight of the scaffold itself is a component of the overall weight that can be supported from the cantilever outrigger beams by the suspending cables. The greater the weight of the scaffold itself, the less payload, in the form of men, equipment and supplies that can be supported by the scaffold. The use of these heavy scaffold components, while providing the needed structural rigidity and strength, also reduces the weight of the workmen and supplies that each scaffold can carry. In addition, a heavy scaffold structure requires more labor to assemble, disassemble and transport. The prior scaffolds have thus been expensive to put together, to take apart, and to transport.

In the unlikely event of the failure of one or more of the suspension cables, the scaffold being supported by these cables must retain its structural integrity. It may tilt or drop at the point where the supporting cable has slipped or broken, but it cannot fail structurally. The scaffold must remain assembled at all times. In the past, this has again given rise to scaffold structures which have required a number of braces. While the use of such an arrangement of a plurality of braces has insured that the scaffold will maintain its structural integrity, it has also added to both the complexity and the weight of the resultant scaffold. As noted above, since virtually all scaffolds are assembled on a particular job site, used for a finite length of time at that job site and then taken apart and transported to another job site, the use of a large number of braces and reinforcing rods has added to the time needed for assembly and take down and has also added substantial weight to the scaffolds.

Various government regulations require that all scaffolds have certain features which are intended to aid in maintaining the safety of the workers who are using the scaffold. One of these requirements is the provision of toeboards that are used to prevent the toes or feet of the workmen from extending out past the working surface of the scaffold. This is important in the prevention of injuries. Another is the provision of guard rails at specified locations. Mesh is also typically required to prevent the likelihood of objects falling off the scaffold. However, the provision of these government-mandated toeboards, guard rails and retention mesh has required the installation of additional elements in the assembly of each scaffold. In the prior scaffolds, the sole purpose of the toeboard was to act as a guard for the feet of the workers. Guard rails were also thought of as being only for protection. The same was true with respect to retention mesh or netting. No thought was given to the possible use of these toeboards, guard rails and mesh as structural components of the scaffold. The result again has been an unduly complex structure that is time-consuming to assemble and to take apart and that is heavy and cumbersome to transport between job sites.

Prior scaffold assemblies have tended to be heavy, cumbersome structures that are labor intensive to assemble and to disassemble. They have used components that provide structural rigidity at the expense of reduced weight. While they have been safe and have complied with the applicable government rules and have met the necessary standards, they have not done so using a structure that is lightweight, and structurally uncomplicated. The multi-point suspended scaffold in accordance with the present invention, as will be set forth subsequently, overcomes these limitations of the prior art and is a substantial advance in the art.

SUMMARY OF THE INVENTION

It is an object of the present invention to provide a multi-point suspended scaffold.

Another object of the present invention is to provide a scaffold that uses spaced tubular metal frames joined by wire mesh trusses.

A further object of the present invention is to provide a multi-point suspended scaffold which has support decks at two different elevations.

Yet another object of the present invention is to provide a multi-point suspended scaffold which includes spaced frames which are connected to adjacent frames by upper and lower cross braces and by wire mesh trusses.

Still a further object of the present invention is to provide a scaffold assembly having the required toeboards, guard rails and retention mesh as parts of the wire mesh trusses.

Even yet another object of the present invention is to provide a multi-point suspended scaffold which will comply with all applicable government regulations and which will have improved structural rigidity and reduced weight.

As will be described in greater detail in the description of the preferred embodiments, which is set forth subsequently, the multi-point suspended scaffold in accordance with the present invention is constructed using spaced, standardized frames. Each frame includes a pair of spaced suspension points that will each receive a mechanical hoist or winch. Two of the frames can be joined together by the use of wire mesh trusses and by upper and lower cross braces to form a structurally rigid unit. Each such scaffold unit includes upper platforms that can function as supply staging areas and as walkways for support personnel. The scaffold also includes a lower platform on which a skilled worker will stand. The upper platforms are generally at hip height with respect to the skilled workmen standing on the lower platform and thus provide a convenient and easily accessible support area for the materials which the skilled workman, typically a mason, is apt to need to perform his tasks.

In contrast with prior scaffolds, the multi-point suspended scaffold in accordance with the present invention is less complicated structurally, is easier to assemble and to take apart, provides greater space for movement of skilled workers and assistants, has greater structural rigidity with reduced weight and is generally better suited to performing the tasks for which it is intended. In prior scaffolds, there were three bars or rods that were individually positioned along the rear of the scaffold. These included a top guard rail located at generally waist height, a middle guard rail at 19 inches above the deck and the toeboard with a height of 4 inches. Each one of these was installed separately and was a separate component. Further, a mesh retention material had to be installed between the top of the toeboard and the upper or top guard rail. This was typically in the form of a plastic mesh material that was not easily or effectively installed. In contrast, in the scaffold of the present invention, the steel mesh trusses are single components that include the top guard rail, the middle guard rail, the mesh, and in the case of the lower steel mesh trusses, also includes the toeboards. The result is a unified structure that is much more readily and correctly installed. In actual usage, it has been seen that the scaffold in accordance with the present invention, is readily understood and assembled by the end users. This assembly takes place in far less time than was required by prior scaffold assemblies.

The multi-point suspended scaffold of the present invention allows the assemblage of a plurality of scaffold sections in a manner that allows ease of access by the workmen and helpers. In the situation of use of such a scaffold assembly by masons who are building or blocking a wall, there is provided unencumbered access to supplies and the ability for the mason's assistants to replenish those supplies quickly. Each scaffold section can be placed adjacent other similar sections. The absence of vertical or vertically diagonal bracing means that there are unencumbered passages between adjacent scaffold sections. Transport of bricks, blocks, mortar and ancillary supplies along the main, upper deck are facilitated by the double width of the deck and by the unobstructed ends of each scaffold section. The location of the lower deck, with respect to the upper deck, as was discussed above, allows the placement of the supplies required by the mason, for example, at a height which is easy for him to access.

In the multi-point suspended scaffold of the present invention, the use of the steel mesh trusses provides great structural rigidity at reduced weight. Unlike prior structures that used separate top or upper and middle guard rails, a separate toeboard and removable mesh, the steel mesh trusses of the present invention are one piece units that provide better strength, reduced weight and easier, quicker assembly than did the prior multi-component structures. This gives rise to reduced assembly times, to reduced parts inventories, to improved workman safety and to an overall higher level of satisfaction with the scaffold. This is possible because of the simplification of the assembly by the use of the steel mesh trusses.

The scaffold is formed by the connection of two frames that are each able to be broken down into an upper frame section and a lower frame section. The overall height of the assembled frame units is approximately 10 feet. This will allow sufficient head room for the passage of helpers and other persons between adjacent scaffold sections. It does however, present a slight shipment and handling issue. To overcome that, each of the frames is separable into an upper frame section and a lower frame section by the use of a connection which allows the two sections to be easily separated and reconnected. This increases the ease of transport and handling of the frame sections while not diminishing their structural integrity.

The multi-point suspended scaffold in accordance with the present invention overcomes the limitations of the prior art. It provides greater structural integrity at reduced weight and with fewer components than its predecessors. It is simpler to assemble, easier to use and safer than prior scaffolds. It can be broken down and shipped with fewer components and in a faster time than was able to be accomplished using the prior devices. The multi-point suspended scaffold of the present invention is thus a significant improvement over prior devices and is a substantial advance in the art.

BRIEF DESCRIPTION OF THE DRAWINGS

A full and complete understanding of the multi-point scaffold assembly in accordance with the present invention may be had by referring to the description of the preferred embodiment, as is set forth subsequently, and as illustrated in the accompanying drawings, in which.

DESCRIPTION OF THE PREFERRED EMBODIMENT

Figure 1:
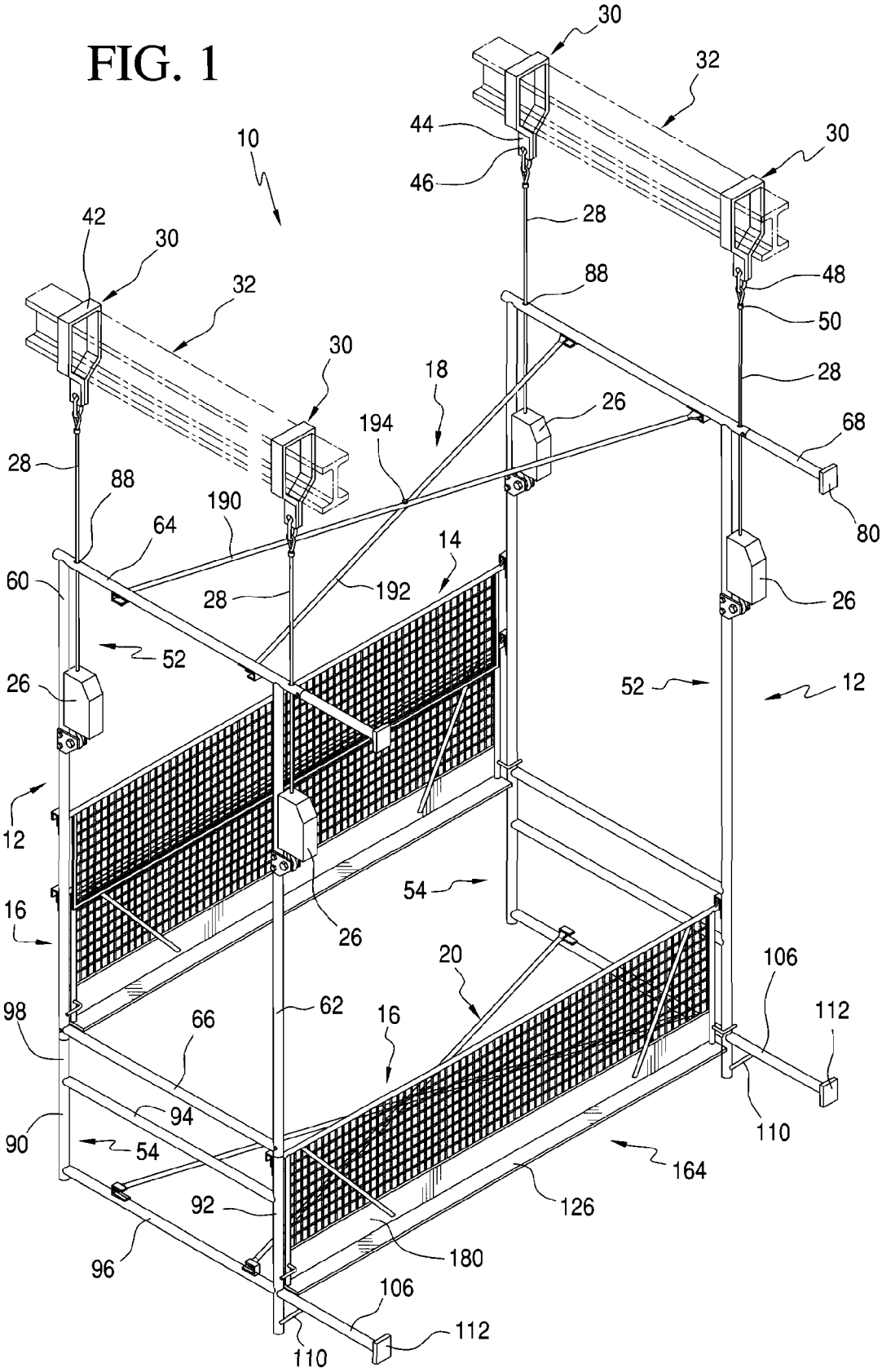
FIG. 1 is a perspective view of a multi-point suspended scaffold in accordance with the present invention and with the upper and lower floor boards removed for clarity.

Referring initially to FIG. 1, there may be seen generally at 10 a preferred embodiment of a multi-point suspended scaffold in accordance with the present invention. The suspended scaffold seen generally at 10 in FIG. 1 is typically part of a multiple component scaffold assembly, each of which is the same as the scaffold 10 depicted in FIG. 1. While the plurality of adjacent scaffold 10 that are typically combined to form the multiple component scaffold assembly are not specifically depicted, it will be understood that while the multi-point suspended scaffold 10 shown in FIG. 1 can be used by itself, it is more typical for a plurality of such scaffolds 10 to be placed side by side and typically interconnected to form a multiple component scaffold assembly. It is only for purposes of ease of illustration that such an arrangement is not depicted.

As may be seen in FIG. 1, the multi-point suspended scaffold, generally at 10, is comprised of two generally identical scaffold frames 12. These two scaffold frames 12 are interconnected by one upper or top wire mesh truss, generally at 14, by two lower wire mesh trusses 16 and by upper cross braces 18 and lower cross braces 20. Each of these structural components of the multi-point suspended scaffold 10 will be discussed in detail subsequently. As may be seen in FIG. 2, a pair of upper footboards 22 and a similar lower footboard 24 also connect the two scaffold frames 12 to complete the suspended scaffold, generally at 10.

Each of the scaffold frames 12 is provided with a pair of winches, generally at 26, each of which is connected to its respective scaffold frame 12. Each winch carries a length of suspension cable 28 that terminates, at its upper end, in a cable ring 30. As is generally well known in the art, the cable rings 30 are sized to fit around cantilever outrigger beams, generally at 32. As may be seen more clearly in FIG. 3, each one of the outrigger beams is supported, typically pivotably, at an inboard end 34 to a building, generally at 36. The building 36 and the attachment of the outrigger beams 32 to the building are well known in the art and do not form any part of the present invention.

In use, the cantilever or outrigger beams 32, which are spaced at fixed intervals along the roof 38 of the building, are deployed either by being slid or pivoted outwardly. The suspension cables 28 are deployed from their respective winches 26 to provide adequate line slack so that the cable rings 30 can be slid around the beams 32. While these beams 32 are depicted as being I-beams, it will be understood that these are representative of various beam configurations that are usable. It will also be understood that suitable structures are provided on the beams, in accordance with well-known safety practice, to secure the cable rings in place on the beams at fixed locations. These locations of several of the cable rings 30 on the outrigger beams are selected so that the scaffold 10 will be supported adjacent to, but out of contact with a wall 40 of the building 36.

As may be seen by again referring to FIGS. 1-4, the cable rings 30 are generally flat metal strips or bands 42 that have been bent into a somewhat pentagonal shape with a pair of free ends 44 that are each provided with a bore 46. The bores 46 on the two free ends 44 of each strip 42 are aligned with each other and can receive an ovoid attachment link 48 which, in turn will receive a cable eye 50 that has been formed in the suspension cable 28. The benefit of forming each cable ring 30 using a flat metal strip 42, as opposed to a bent metal rod, as is typically done in the prior art, is to reduce the stress distribution in the cable rings 30. A flat surface of the cable ring 30 engages the flat surface of the I-beam 32. In the prior arrangements, which typically use a bent metal rod, there is a line contact between the bent ring and the beam 32. The flat plate contact offered by the use of the metal strip 42 reduces this stress concentration.

Figure 2:
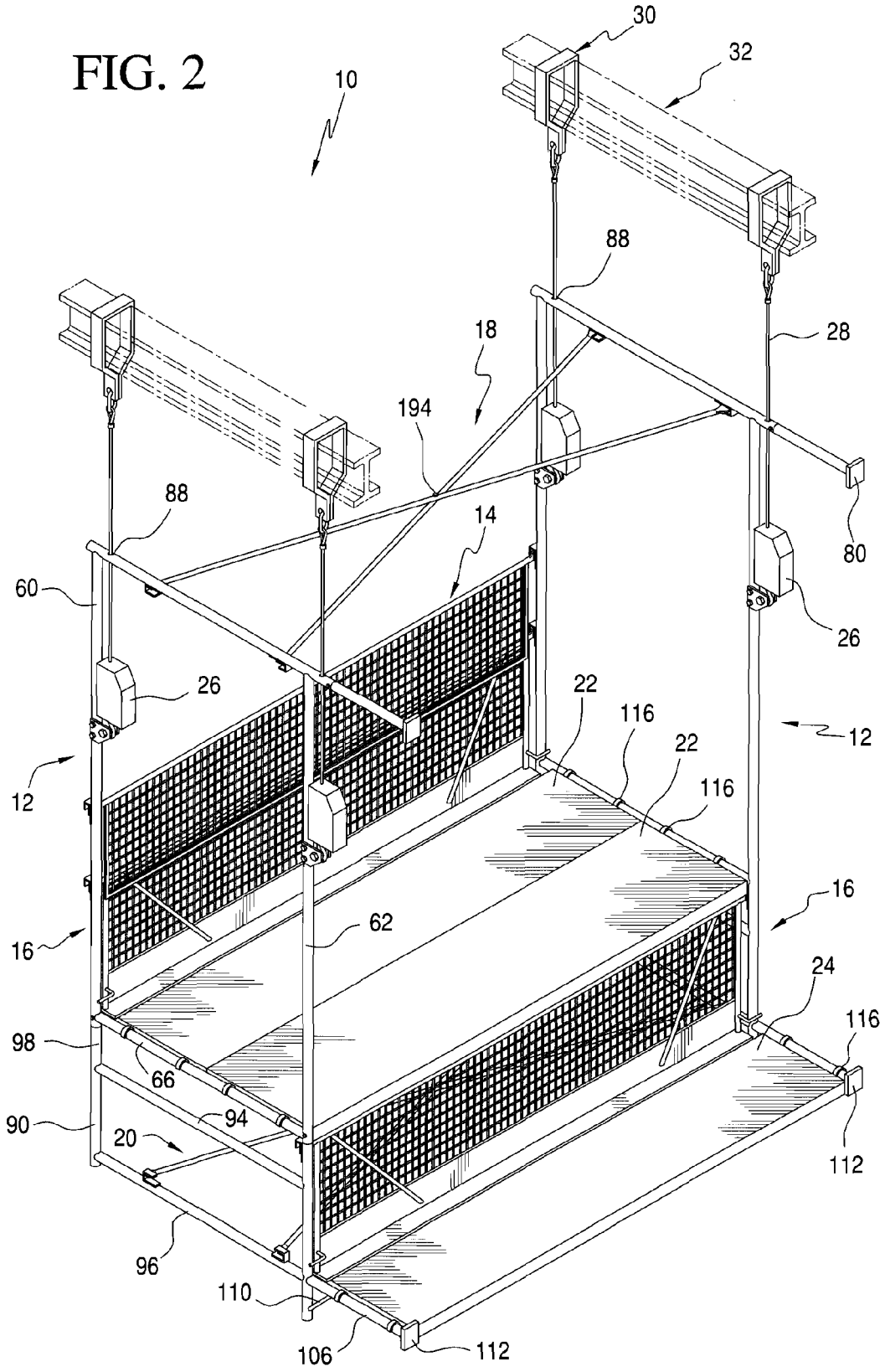
FIG. 2 is a perspective view similar to FIG. 1 and showing the floor boards in place.
Figure 3:
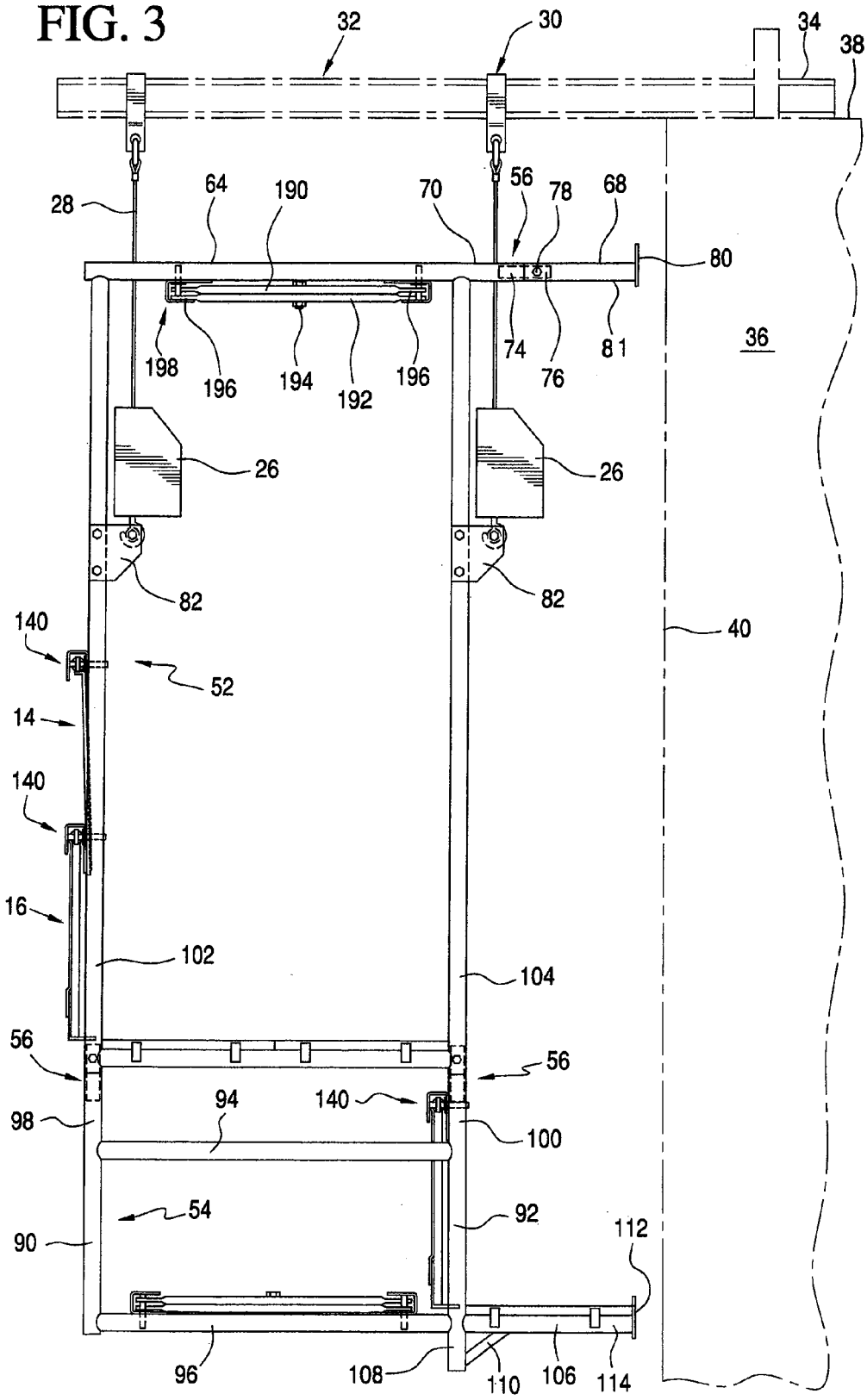
FIG. 3 is a side elevation view of the multi-point suspended scaffold and showing the side of a building and the outrigger beams in phantom line.
Figure 4:
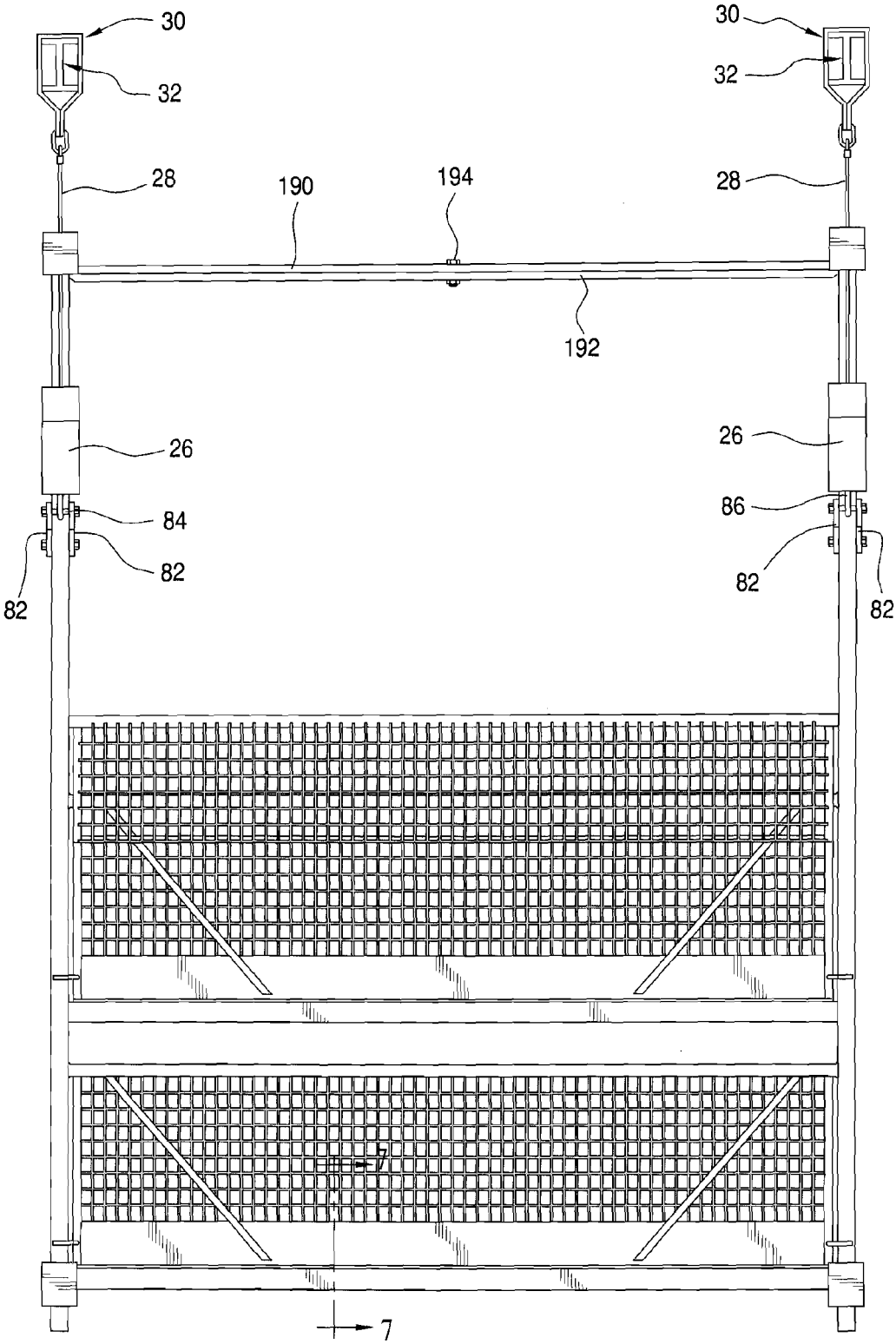
FIG. 4 is a front elevation view of the multi-point suspended scaffold.

Each of the scaffold frames 12 is comprised of an upper scaffold frame section 52 and a lower scaffold forme section 54 as may be seen in FIGS. 1-3. Each of these scaffold frame sections 52; 54 is preferably fabricated of metal tubing elements that can be connected to each other by welding or other suitable methods of connection. Each scaffold frame is generally four feet wide and ten feet high. Since the overall length of 10 feet of each scaffold frame 10 makes it more challenging to handle and manipulate, the scaffold frames 10 are, as discussed above, separable into the upper scaffold frame section 52 and the lower scaffold frame section 54. As is depicted in FIG. 3, this separation may be accomplished by a peg and bolt connection, generally at 56, as will be discussed in detail below.

The upper scaffold frame section 52 is a generally rectangular frame that is composed of an outer upper section vertical tube 60, an inner upper section vertical tube 62, a top upper section horizontal tube 64 and a bottom upper section horizontal tube 66. These four upper scaffold frame section tubes 60, 62, 64 and 66 are typically round steel tubing. However, they could have other cross-sectional shapes and could be made of other materials. The four tubes 60, 62, 64 and 66 are typically welded together to form the upper scaffold frame section 52 depicted in FIGS. 1 and 2.

As can be seen perhaps most clearly in FIG. 3, a top extension tube 68 is removably connected to an inboard end 70 of the top upper section horizontal tube 64 by a suitable peg and bolt coupling, generally at 56. A peg 74 can be welded into the inboard end 70 of the top upper section horizontal tube 64 and has a free end 76 that projects beyond the inboard end 74 of the tube 64. A bolt 78 is usable to secure the top extension tube 68's outer end to the free end 76 of the peg 74. Such peg and bolt couplers 56 are used at other places on the scaffold frame 12 and will be referred to hereinafter as peg and bolt couplers. One such coupler was discussed briefly in respect to the connecting together of the upper and lower scaffold frame sections 52 and 54.

An upper stop plate 80 is attached to an inboard end 81 of the top extension tube 68 of the upper scaffold frame section 52. This upper stop plate 80 is, as is shown in FIG. 3, not intended to continually engage the vertical wall 40 of the building 36. Such a continuous engagement could damage the building. Instead, the upper stop plate 80 is intended to act as a stop in the situation where the scaffold 10 may tend to swing with respect to the building 36.

A pair of spaced frame pick-up plates 82 are bolted or otherwise secured to each of the outer and inner upper section vertical tubes 60; 62 respectively, as may be seen in FIGS. 1-4. These two spaced frame pick-up plates 82 that are secured to each of the upper scaffold sections vertical tubes 60; 62 support a frame plate pin 84 that passes through both of the plates 82. This pin 84, which is typically removable from between the two spaced frame pick-up plates 82, is usable to form an attachment point for one of the winches 26 that are connected to each one of the upper scaffold frame section vertical tubes 60; 62. Each such winch 26 can have a suitable hook or other connector 86 through which the frame plate pin 84 can pass. The winch 26 can be disconnected from the spaced apart frame pick-up plates by removal of the frame plate pin 84 which will be understood to have suitable assemblies, such as cotter pins or lock pins to prevent inadvertent pin withdrawal.

As discussed above, each winch 26 carries a length of suspension cable 28 that extends between the winch 26 and the cable ring 30. Each one of these suspension cables 28 passes through a cable sleeve 88 which is situated in the top upper section horizontal tube 64. These cable sleeves 88 serve to stabilize the scaffold frames 12 on their respective suspension cables 28.

Referring again to FIGS. 1-3 the scaffold frame lower frame section 54 is also generally rectangular. It is comprised of an outer lower section vertical tube 90; an inner lower section vertical tube 92; a top lower section horizontal tube 94 and a bottom lower section horizontal tube 96. As was the case with the upper scaffold frame section 52, all of the tubes 90; 92; 94 and 96 in the lower scaffold frame section 54 are typically round metal tubes, which tubes are connected to each other by welding or the like to form a generally rectangular lower scaffold frame section.

The two lower frame section vertical tubes 90 and 92 each has an upper end 98 and 100; respectively. These upper ends 98 and 100 are releasably connected to lower ends 102, 104 of the upper section vertical tubes 60 and 62, respectively. This releasable connection is accomplished again through the use of suitable peg and bolt couplings or connections, again indicated at 56 and described in detail above. It will be understood that other secure yet releasable couplers or connections can be utilized to couple the lower scaffold frame section 54 and the upper scaffold frame section 52 to each other to form the resultant scaffold frame 12. As was discussed above, the overall scaffold frame 12 has a length of approximately ten feet. The ability to disassemble the scaffold frame 12 into its upper and lower frame sections 52 and 54 facilitates handling and shipment of the frame sections.

A working level horizontal tube 106 is attached, typically in a permanent manner, to the inboard side of the inner lower frame section vertical tube 92. As may be seen more clearly in FIG. 3, an exterior leg 108 of the inner lower frame section vertical tube 92 extends down below the bottom lower section horizontal tube 96. The exterior leg serves as an attachment point for a lower end of a diagonal support plate 110 that extends between the leg 108 and the working level horizontal tube 106. As will be discussed in detail shortly, this working level horizontal tube 106 provides the support for the lower footboard 24, as is depicted schematically in FIG. 2.

A lower stop plate 112 is attached to an inboard end 114 of each of the working level horizontal tubes 106. Each such lower stop plate 112 is generally equivalent, in function, to its associated upper stop plate 80. When the scaffold, generally at 10 is properly suspended, by its multiple suspension cables 78 from the outrigger beams 32, it will be spaced closely to, but will not be in contact with the vertical wall 40 of the associated building 36. As was discussed above, such contact between the stop plates 80 and 112 and the building 36 is apt to occur only if the multi-point suspended scaffold 10 is caused to swing. Such a swinging motion is not expected to occur on a recurring basis. The stop plates 80 and 112 are preferably spaced from the building wall 40 by several inches. In addition, the lower stop plates 112 serve to retain the lower footboards 24 in place and prevent them from sliding toward the building.

Turning now to FIG. 2, the multi-point suspended scaffold, generally at 10 is formed by the connecting of the two spaced scaffold frames by a pair of upper footboards 22 and one lower footboard 24. These footboards 22; 24 are generally known in the art. They are typically 19 inches in width and come in varying lengths. Each footboard 22; 24 has a pair of spaced corner or end hooks, generally at 116. Each such end hook 116 is dimensioned to fit over an associated one of the bottom upper section horizontal tubes 66 or the working level horizontal tubes 106. Each such footboard corner or end hook 116 is typically provided with an associated slide latch, which is not specifically depicted, so that the footboards 22 or 24 will not become inadvertently disconnected from their associated tubes 66 or 106.

As is generally known in the art, these footboards 22 and 24 are typically made of plywood or aluminum. They are sufficiently rigid to be able to support the weight of men and materials during use of the multi-point scaffold 10. The lower footboard 24 is sufficiently lower than the upper footboards 22 so that a skilled tradesman, such as a mason can stand on the lower footboard 24 while a helper or assistance stacks materials, such as bricks or blocks and mortar on a forward edge of the inner one of the upper footboards 22. This places the materials generally at the level of a hip of a skilled tradesman who is standing on the lower footboard 24. The laborer can easily provide the materials required by the skilled tradesman because the width of the upper scaffold frame section is wide enough to accommodate the positioning of two upper footboards 22 side by side. While not specifically depicted in FIGS. 1 and 2, it will be understood that the multi-point suspended scaffold, generally at 10, is intended to be used in conjunction with other similar scaffolds which are all suspended by suitable suspension cables 28 from spaced ones of the outrigger beams 32. As may be seen in FIGS. 1, 2 and 3, the ends of each scaffold 10 are unobstructed by cross braces or reinforcements. This allows ease of movement of both the skilled tradesman on the lower footboard 24 and his assistants or laborers along the upper footboards 22. When a plurality of scaffold frames are assembled, suitable guard rail standards are provided at the frame ends for safety.

Each multi-point suspended scaffold 10 is formed by the combining of two spaced scaffold frames 12. This connection is accomplished, in part, by the securement of the footboards 22 and 24 to the associated tubes 66 and 106. That connection is not however sufficient to provide the rigidity and resistance to separation of the scaffold frames 12 which is required to provide a safe, secure multi-point suspended scaffold. In accordance with the present invention, that connection or joining of the scaffold frames 12, to form the multi-point suspended scaffold, is accomplished primarily through the use of the upper wire mesh truss 14 and the lower wire mesh truss 16. In part, that secure, rigid connection of the embodiment, spaced scaffold frames 12, to form the multi-point suspended scaffold 10 is also accomplished by the provision of the upper cross bracesl8 and the lower cross braces 20. These will now be discussed in detail.

Scaffolds are required, by various governmental regulations, to include guard rails, toeboards and mesh to prevent workmen and/or materials from falling off and either being injured or injuring people below the scaffolds. In the past, these guard rails, toeboards and mesh assemblies were all separate items that had to be provided and secured to the scaffold frames separately. These prior guard rails and toeboards were also not typically used as part of the scaffold structure in the sense of providing structural rigidity. The wire mesh trusses, either without or with integral toeboards, 16 and 18 respectively and in accordance with the present invention provide both requirements of protection and structural rigidity.

Figure 6:
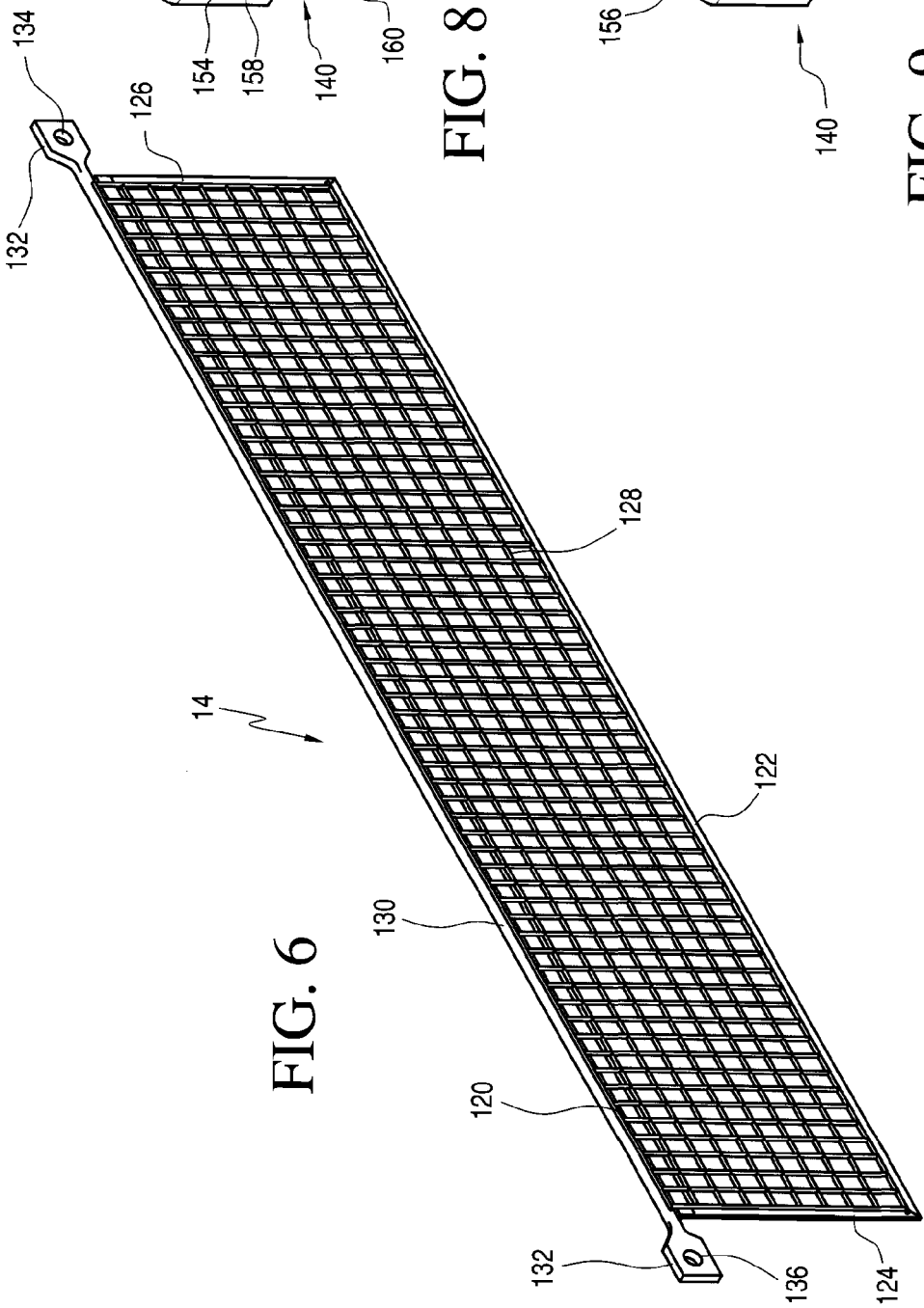
FIG. 6 is a perspective view of an upper screen panel truss.

Referring to FIG. 6, there may be seen, generally at 14, an upper or top wire mesh truss in accordance with the present invention. This upper wire mesh truss 14 is so designated because it does not include an integral toeboard, as do the lower wire mesh trusses 16 that will be discussed in detail subsequently. The upper or top wire mesh truss, generally at 14 is generally rectangular in front elevation view and is formed by an upper truss top horizontal tube 120, an upper truss bottom horizontal tube 122, a left upper truss vertical end tube 124 and a right upper truss vertical end tube 126. All of these tubes are preferably hollow metal tubing and are preferably square or rectangular in cross-section. A truss wire mesh, generally at 128 is welded or otherwise secured to each of the four upper mesh truss tubes. The weldment or other securement used to attach the truss mesh 128 to the upper mesh truss tubes 120; 122; 124 and 126 is not specifically depicted in FIG. 6. While welding is preferred, it is not the sole type of attachment between the mesh and the tubes that could be utilized.

A top guard rail 130 is joined both to the upper truss top horizontal tube 120 and also to an upper edge of the truss wire mesh 128. Again, welding is the preferred, but not the sole method of attachment that can be used. The top guard rail 130 is preferably round tubing and has flattened attachment ends 132 which are positioned outbound of the upper truss vertical end tubes 124 and 126. Each such flattened attachment end 132 is provided with an attachment bore 134 whose use will now be discussed. It is to be understood that the upper or top wire mesh truss 14, as its name implies, forms a truss or a structural member that has the requisite stiffness and rigidity to serve as a connective member between two spaced ones of the scaffold frames 12.

Figure 8:
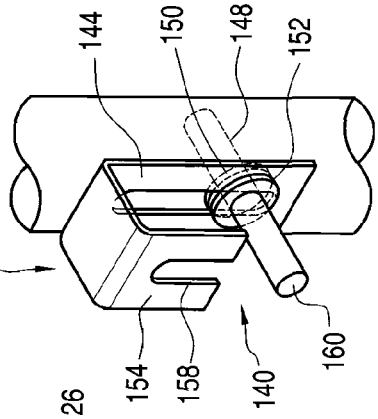
FIG. 8 is a perspective view of a slide or drop lock assembly in an open position.
Figure 9:
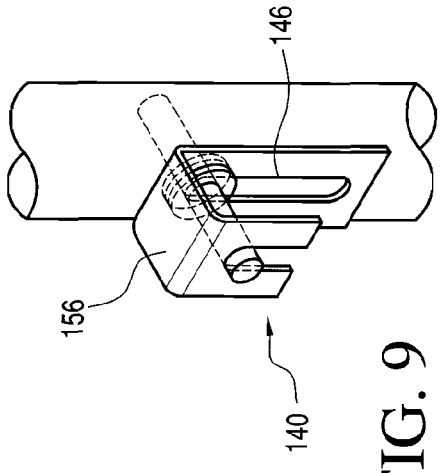
FIG. 9 is a perspective view of the slide or drop lock assembly in its closed position.

As may be seen more clearly in FIGS. 8 and 9, a number of the tubes of the scaffold upper and lower frame sections carry one or more drop locks or slide locks, generally at 140. In the arrangement depicted in FIGS. 8 and 9, the lock 140 is a drop lock because it is oriented generally vertically and gravity will cause the lock to drop. When the lock, generally at 140, is attached to a horizontal tube, such as the top upper section horizontal tube 64 or the bottom lower section horizontal tube 96, the lock will be slid generally horizontally between locking and unlocked portions. It may there be referred to as a slide lock. In both orientations, the structure and function are the same. In both orientations, while not specifically depicted, a suitable biasing element, such as a spring, could be used to maintain the lock in its locked position. Typically, friction is supposed to do so, but a biasing force may be provided, if believed to be appropriate.

Referring to FIGS. 8 and 9, a generally U-shaped lock slider 142 has an inner leg 144 that is formed with an elongated, closed aperture 146. A lock pin 148 is first provided with an attached inner spacer washer 150. The closed aperture 146 is then slid over the pin, outboard of the inner spacer washer 150. A second outer spacer washer 152 in then slid onto the pin and is welded in place. The lock slider 142 is now secured to the pin 148 between the two spacer washers 150; 152 and is free to slide along the length of the elongated aperture 146. The lock slider 142 is held on the lock pin 148 by the spaced, welded inner and outer spacer washers 150 and 152, respectively.

As outer leg 154 of the U-shaped lock slider 142 is connected to the inner leg by a connection web 156. The outer leg 154 has a downwardly opening slot 158 which is dimensioned, and spaced from the inner leg 144 by the connecting web 156 so that it will engage an outer end 160 of the lock pin 148.

In use, ones of these drop or slide locks 140 are secured to the scaffold frame tubes at suitable locations. The inner end of the lock pin 148, inboard of the inner spacer washer 150, is inserted into an appropriately located aperture in the selected tube, and the inner spacer washer 150 is welded to the tube. It would also be possible to have the inboard end of the lock pin 148 extend through the associated tube and be held a place by a cotter pin or snap lock pins or possibly by a threaded bolt connection. Once the lock pin 148 has been appropriately positioned, the lock slide 142 is raised, as depicted in FIG. 8. A flattened end 132, for example of the top guard rail 130 of the upper or top wire mesh truss 14, can be attached to the drop lock 140 by passage of the outboard end 160 of the lock pin 148 through the aperture 134 in the flattened end 132. Once this has been done, the lock slide can be slid into its closed position, as seen in FIG. 9. Once this has been done at both ends of the upper wire mesh truss 14, that truss 14 is securely situated between the two spaced scaffold frames 12, as may be seen in all of FIGS. 1-4. It will be noted that the upper wire mesh truss is located on the outer side of the scaffold frames 12; i.e. the side of the outer upper frame section vertical tubes 60 of the two scaffold frames 12 that are more remote from the building 36.

Figures 5, 7:
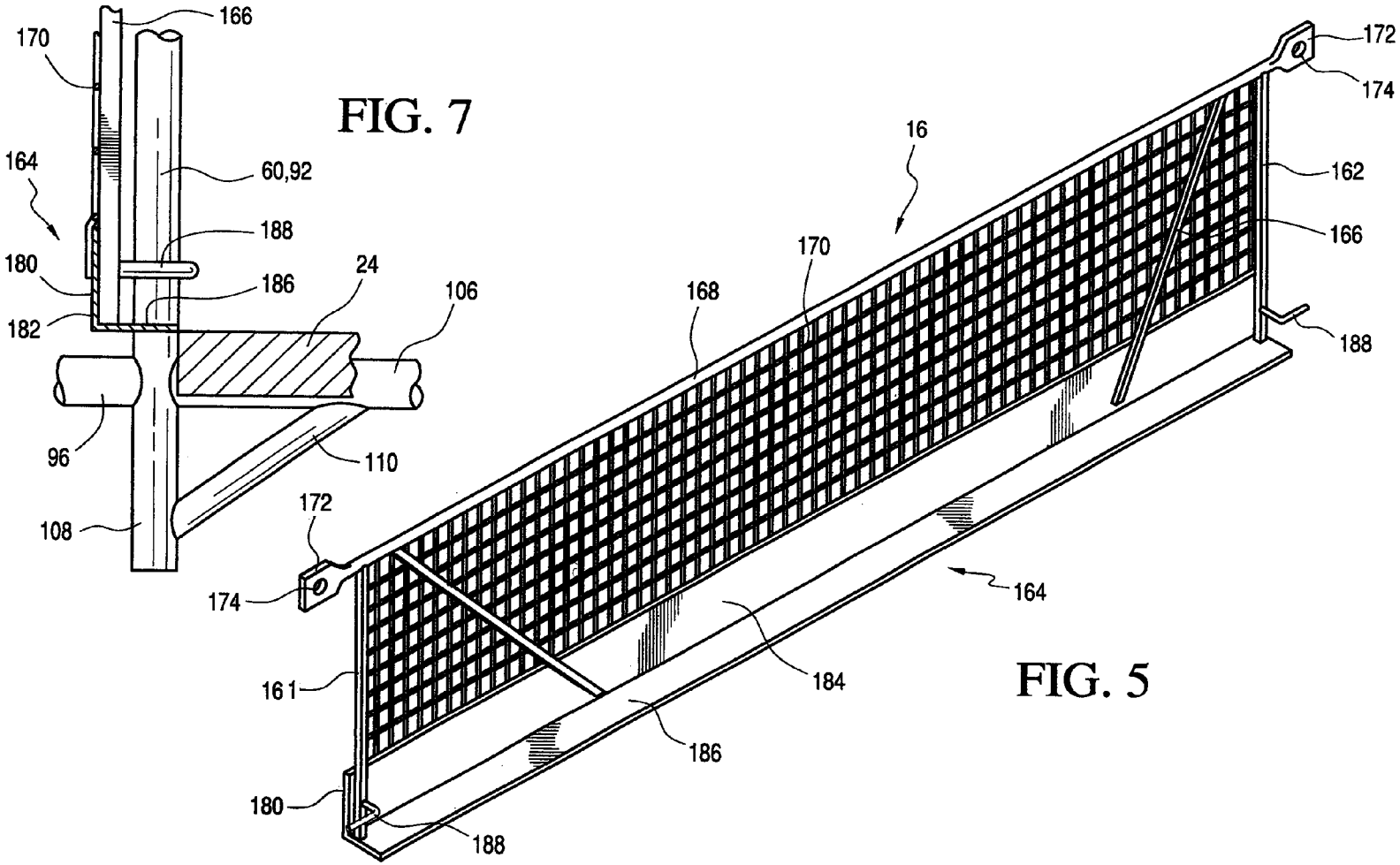
FIG. 5 is a perspective view of a lower screen panel truss and showing the integral toeboard.
FIG. 7 is a partial cross-sectional view of the portion of the scaffold taken along line 7-7 of FIG. 4.

A generally similar lower wire mesh truss, generally at 16 is depicted in detail in FIG. 5. This lower wire mesh truss 16 includes spaced left and right vertical lower tubes 161 and 162, a toeboard, generally at 164, a pair of lower wire mesh truss diagonal tubes 166 and a middle guard rail 168. The vertical tubes 161; 162; the toeboard 164 and the middle guard rail 168 cooperate to form a generally rectangular rigid frame to which is secured a truss wire mesh 170, generally the same as the truss wire mesh 128 used on the top wire mesh truss 14. The wire mesh 170 is secured to the tubes 161; 162, to the toeboard 164 and to the middle guard rail 168 by welding or any other appropriate type of securement. The vertical tubes 161 and 162 and the diagonal tubes 166 are preferably square or rectangular hollow metal tubing. This facilitates the attachment, by welding, of the wire mesh 170 to them. The middle guard rail 168 is preferably a round metal tube. It has flattened ends 172 with apertures 174 whose use is the same as the corresponding parts of the upper guard rail 130 of the upper wire mesh truss 14.

As may be seen in FIGS. 5 and 7 the toeboard, generally at 164 of the lower wire mesh truss 16 is generally L-shaped in side elevation view. It has a vertical leg 180 with an outer surface 182 on which the wire mesh 170 is welded, and an inner surface 184 on which the lower ends of the diagonal tubes 166 are welded. A bottom plate 186 of the L-shaped toeboard 164 is generally horizontal in the use position of the lower wire mesh truss 16. A hook ear 188 is secured to each one of the vertical tubes 160, 162 of the lower wire mesh truss, as seen in FIG. 5. The hook ears 188 are sized and positioned to engage a respective one of the outer upper scaffold frame section vertical tube 60 or the inner lower scaffold frame section vertical tube 92 when the lower wire mesh trusses are attached to the respective upper scaffold frame section 52 and to the lower scaffold frame section 54, as seen in FIGS. 1-4.

When the lower wire mesh truss 16 is secured to the upper scaffold frames 52, by use of the drop or slide locks 140, as has been discussed previously in connection with the securement of the upper or top wire mesh trusses 14, it will be noted, as depicted more clearly in FIG. 3, that the upper wire mesh truss 14 and the lower wire mesh truss 16 are installed in a somewhat overlapping or imbricated arrangement. The lower wire metal truss 16 is installed first and the upper wire metal truss 14 is installed next. The middle guard rail 168 of the lower wire mesh truss 16 underlies or is on the outer side of the wire mesh 128 of the subsequently installed upper wire mesh truss 14, as seen most clearly in FIG. 3. The upper wire mesh truss 14 overlies, or is inside of, the middle guard rail 168 of the lower wire mesh truss 16. This installation, together with the engagement of the hook ears 188 of the lower wire mesh truss 16 with the outer upper scaffold section vertical tubes 60 of the two adjacent scaffold frames 12 serves to rigidify the assembled multi-point suspended scaffold before it is placed into use.

The bottom plate 186 of each toeboard, generally at 164, is adjacent to, and covers an outer edge of its associated one of the footboards 22 or 24. In the depiction of FIG. 7, the toeboard, generally at 164 is shown adjacent to, and overlying the outer edge of the lower footboard 24 that is supported by the working level horizontal tubes 106 of the spaced lower scaffold frame sections 54.

The upper and lower wire mesh trusses 14; 16, in accordance with the present invention, perform multiple functions. Each one of the trusses includes a guard rail, either the upper guard rail or the middle guard rail. Each one of the wire mesh trusses 14; 16 is securely attached to its associated scaffold frame sections and joins the two scaffold frame sections to solidify and to rigidify the multi-point suspended scaffold. In the case of the lower wire mesh trusses 16, the integral toeboards 164 further increase the rigidity of each such lower wire mesh truss 16 while also providing the required barrier so that a worker cannot extend his foot out of the scaffold. Further, the middle guard rail 168 of the lower wire metal truss 16, when the truss is used in combination with the lower scaffold frame section 54, effectively closes the space between the lower footboards 24 and the inner one of the upper footboards 22. This again closes potential gaps or spaces.

Further structural rigidity is provided to the assembled multi-point suspended scaffold by the provision of the upper cross braces 18 and the lower cross braces 20. Each of these cross braces is a generally X-shaped assemblage of two elongated metal tubes 190 and 192. These tubes are connected to each other at a pivot connection 194 equidistant their ends. Those ends 196 are provided as flattened ends with apertures, which are not specifically seen and which are engaged by, in this case, slide locks 198. These slide locks 198 are the same, in structure, as the drop locks 142 depicted in FIGS. 8 and 9. They are oriented 900 from the depiction shown in FIGS. 8 and 9. Their structure and operation is the same. As discussed above, it may be appropriate to provide the horizontally oriented slide locks 198 with biasing elements, such as possibly springs so that an additional force, other than friction, can be relied on to keep the slide locks in their closed positions. The upper cross brace 18 and the lower cross brace 20 are identical in structure and function. They combine with the wire mesh trusses 14 and 16, and with the footboards 22 and 24 to securely connect adjacent ones of the scaffold frames 12 to provide the resultant multi-point suspended scaffold in accordance with the present invention.

While a multi-point suspended scaffold, in accordance with the present invention, has been set forth fully and completely hereinabove, it will be apparent to one of skill in the art that various changes could be made in, for example, the type of winches used, the specific structure of the outrigger beams, the materials used for the footboards, and the like, without departing from the true spirit and scope of the invention which is accordingly to be limited only by the appended claims.

What is claimed is:

1. A multi-point suspended scaffold comprising:

a first scaffold frame;

a second scaffold frame parallel to, and spaced from, said first scaffold frame;

first and second suspension cables secured to and adapted to support each of said first and second spaced scaffold frames;

via first and second spaced winches;

at least one footboard extending between and connecting said first and second spaced scaffold frames;

an upper and a lower unified wire mesh truss structural member, respectively, each extending between and directly connecting said first and second spaced scaffold frames, each of said unified wire mesh truss structural members respectively including a rigid, generally rectangular truss frame and a truss wire mesh which is directly connected within said rigid, generally rectangular truss frame, said upper and lower unified wire mesh truss structural members being imbricated; and securement means connecting each of said upper and lower rigid, generally rectangular truss frames of each of said unified wire mesh truss structural members respectively to said first and second spaced scaffold frames of said scaffold to rigidify and to solidify said multi-point suspended scaffold.

2. The multi-point suspended scaffold of claim 1 further including a cable ring at an end of each of said suspension cables and remote from an associated one of said first and second winches, each said cable ring being adapted to engage an outrigger beam of a building from which said scaffold is intended to be suspended.

3. The multi-point suspended scaffold of claim 1 wherein said lower unified wire mesh truss structural member includes a guard rail and a toeboard.

4. The multi-point suspended scaffold of claim 3 wherein said toeboard includes vertical leg attached to said wire mesh of said lower structural member and a horizontal bottom plate extending away from said wire mesh truss of said lower structural member.

5. The multi-point suspended scaffold of claim 4 further including a hook ear on each of spaced first and second ends of said vertical leg, each said hook ear being engageable with an associated one of said first and second scaffold frames.

6. The multi-point suspended scaffold of claim 1 wherein said upper unified wire mesh truss structural member includes an upper guard rail and further wherein said lower unified wire mesh truss structural member includes a middle guard rail and a lower toeboard.

7. The multi-point suspended scaffold of claim 1 wherein each said generally rectangular truss frame is configured as metal tubing.

8. The multi-point suspended scaffold of claim 1 wherein each of said first and second scaffold frames is a generally rectangular frame and includes spaced upper and lower stop pads.

9. The multi-point suspended scaffold of claim 1 wherein each of said first and scaffold frames includes a respective upper scaffold frame section and a lower scaffold frame section.

10. The multi-point suspended scaffold of claim 9 wherein said respective upper scaffold frame sections and said lower scaffold frame sections of each of said first and second scaffold frames are separably connected to each other.

11. The multi-point suspended scaffold of claim 1 including said at least one footboard including first and second adjacent footboards on a first level of said multi-point suspended scaffold and a third footboard on a second level of said multi-point suspended scaffold, said second level being different from said first level.

12. The multi-point suspended scaffold of claim 11 wherein said second level of said multi-point suspended scaffold is below said first level of said multi-point suspended scaffold.

13. The multi-point suspended scaffold of claim 1 further including at least one cross bracing assembly connecting said first scaffold frame and said second scaffold frame.

14. The multi-point suspended scaffold of claim 13 wherein said at least one cross bracing assembly is generally horizontal.

15. The multi-point suspended scaffold of claim 13 including a second cross bracing assembly connecting said first scaffold frame and said second scaffold frame.

16. The multi-point suspended scaffold of claim 15 wherein said first and said second cross bracing assemblies are both generally horizontal and are spaced apart from each other.

17. The multi-point suspended scaffold of claim 1 wherein each of said first and second scaffold frames is comprised of a plurality of hollow metal tubes and has an overall rectangular shape.

* * * * *

UNITED STATES PATENT AND TRADEMARK OFFICE

CERTIFICATE OF CORRECTION

PATENT NO. : 8,584,803 B2
APPLICATION NO. : 12/508797
DATED : November 19, 2013
INVENTOR(S) : Sani It is certified that error appears in the above-identified patent and that said Letters Patent is hereby corrected as shown below:

In the Claims

Column 12, claim 1, line 19, after “frames”, delete the “;”;

Column 12, claim 4, line 48, after “includes”, insert --a--; and

Column 13, claim 9, line 2, after “and”, insert --second--.

Signed and Sealed this
Third Day of June, 2014

Michelle K. Lee

Michelle K. Lee
*Deputy Director of the United States Patent and Trademark Office*